US006814305B2

(12) United States Patent
Townsend

(10) Patent No.: US 6,814,305 B2
(45) Date of Patent: Nov. 9, 2004

(54) REVERSIBLE ADJUSTABLE ARC SPRINKLER

(75) Inventor: Michael Townsend, Waitsburg, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 252 days.

(21) Appl. No.: 10/216,798

(22) Filed: Aug. 13, 2002

(65) Prior Publication Data

US 2004/0046047 A1 Mar. 11, 2004

(51) Int. Cl.[7] ..... B05B 15/10; B05B 3/00; B05B 3/02; B05B 3/08; F23D 11/04

(52) U.S. Cl. ..... 239/242; 239/206; 239/222.11; 239/222.17; 239/227; 239/233; 239/237; 239/247; 239/252; 239/255

(58) Field of Search ..... 239/242, 206, 239/222.11, 222.17, 227, 233, 237, 247, 252, 255, 214, 223, 224, 230, 243, 251, 258, 463, 479, 483, 498, 503

(56) References Cited

U.S. PATENT DOCUMENTS 4,540,125 A 9/1985 Gorney et al.
4,763,839 A 8/1988 Greenberg
4,805,838 A 2/1989 Greenberg
5,058,806 A 10/1991 Rupar
RE33,823 E 2/1992 Nelson et al.
5,288,022 A 2/1994 Sesser
5,372,307 A * 12/1994 Sesser ..... 239/210
5,671,886 A * 9/1997 Sesser ..... 239/222.21
6,494,384 B1 * 12/2002 Meyer ..... 239/222.11

* cited by examiner

*Primary Examiner*—Michael Mar
*Assistant Examiner*—Darren Gorman
(74) *Attorney, Agent, or Firm*—Nixon & Vanderhye P.C.

(57) ABSTRACT

A reversible, adjustable arc sprinkler head includes a sprinkler body incorporating a fixed nozzle; a spray plate mounted for rotation in one or the other of two opposite directions about a first axis arranged coaxially with a stream emitted from the nozzle, and for back and forth tilting motion about a second axis perpendicular to the first axis, the spray plate having a pair of substantially parallel grooves for selectively receiving the stream, depending on a direction of tilt of the spray plate; and a shift lever formed with an aperture sized to receive the stream. The shift lever is mounted at one end for rotation about a third axis parallel to the first axis, and is enabled to shift the stream from one of the pair of grooves to the other of the pair of grooves to thereby reverse the direction of rotation of the spray plate.

15 Claims, 14 Drawing Sheets

REVERSIBLE ADJUSTABLE ARC SPRINKLER

TECHNICAL FIELD

This invention relates to a reversible, adjustable arc sprinkler head.

BACKGROUND AND SUMMARY OF THE INVENTION

Typical reversible, adjustable arc sprinklers employ various mechanisms to reverse the direction of rotation of the sprinkler head including, for example, mechanical trippers and magnets. See U.S. Pat. Nos. 4,805,838; 4,763,839 and 4,540,125. There remains a need, however, for a reversible, adjustable arc sprinkler of simple and reliable construction.

The present invention provides a reversible, adjustable arc sprinkler head that is driven by the flow of water from a fixed nozzle. In the exemplary embodiment, the sprinkler head is of the type in which a fixed nozzle is mounted within a sprinkler body, and a rotatable spray plate is supported by a cap releasably secured to the body, in axially spaced relation to the nozzle. The spray plate is mounted in a cage that is, in turn, mounted on a shaft for rotation about a first vertical axis through the sprinkler body. The spray plate is also mounted within the cage for tilting movement about a second, horizontal axis, perpendicular to the first axis. The spray plate is formed with a pair of parallel water distribution grooves that are shaped to redirect a vertical stream emitted from the nozzle into a generally radially outwardly directed stream. A center barrier between the two distribution grooves is centered relative to the nozzle, such that when the spray plate tilts in one of two opposite directions, it will receive the stream in one or the other of the two distribution grooves. The spray plate is caused to rotate on the shaft about the first axis in a direction dependent upon which groove receives the stream, which, in turn, is dependent upon the direction of tilt of the spray plate about the second axis.

The distribution grooves have generally vertically oriented inlets and generally horizontally oriented outlets, and the grooves may be covered by a correspondingly shaped "shield" that confines the stream in the respective grooves.

The spray plate cage, as noted above, is secured to one end of a rotatable shaft, and the other end of the shaft may be secured within a viscous retarder "motor" of the type described in commonly owned U.S. Pat. Nos. Re. 33, 823; 5,058,806; and 5,288,022, for controlling the speed of rotation of the spray plate. The cage also supports a horizontally extending shift lever for free rotation about a third axis that is parallel to the first vertical axis. The shift lever is formed with a generally round-shaped aperture that is arranged so that the stream emitted from the nozzle passes through the aperture, upstream of the spray plate grooves. The shift lever is pivotable between a pair of tabs on the spray plate cage and, as explained in greater detail below, serves to deflect the stream sufficiently to cause the spray plate to tilt and thus allow the stream to move from one to the other of the two grooves and thereby reverse the rotation direction of the spray plate.

A generally cylindrically shaped stop assembly is also secured to the sprinkler cap, above the nozzle and surrounding at least a portion of the spray plate cage and the shift lever. The stop assembly includes a first ring component having a first reversing stop formed in an interior surface thereof. A second ring component of the stop assembly is mounted on the first ring component and includes a second reversing stop that is rotationally adjustable relative to the first stop, it being understood that the arcuate distance between the stops (and through which the outer end of the shift lever travels) determines the arc through which the spray plate rotates. Specifically, the shift lever rotates with the stop assembly about the first axis until it contacts one of the reversing stops. Then while the spray plate continues to rotate, the shift lever is forced to rotate about the third axis, moving from is center position and engaging the stream thus shifting the stream away from the spray plate center barrier. This then causes the spray plate to tilt, resulting in a reversal of the direction of rotation of the spray plate.

In its broader aspects, therefore, the invention relates to a reversible, adjustable arc sprinkler head comprising a sprinkler body incorporating a fixed nozzle; a spray plate mounted for rotation in one or the other of two opposite directions about a first axis arranged coaxially with a stream emitted from the nozzle, and for back and forth tilting motion about a second axis perpendicular to the first axis, the spray plate having a pair of substantially parallel grooves for selectively receiving the stream, depending on a direction of tilt of the spray plate; and a shift lever formed with an aperture sized to receive the stream, the shift lever mounted at one end for rotation about a third axis parallel to the first axis, the shift lever enabled to shift the stream from one of the pair of grooves to the other of the pair of grooves to thereby reverse the direction of rotation of the spray plate.

In another aspect, the invention relates to a reversible, adjustable arc sprinkler head comprising a sprinkler body incorporating a nozzle having a discharge orifice; a cap releasably mounted on the body; a spray plate mounted in a cage for tilting motion relative to the cage about a horizontal axis; the cage and spray plate mounted in the cap for rotation relative to the sprinkler body about one vertical axis perpendicular to said horizontal axis, the spray plate having formed therein a pair of substantially parallel grooves adapted to be sequentially aligned with the nozzle for receiving a stream from the nozzle, the pair of grooves separated by a center barrier and configured to cause rotation of the cage and spray plate in one of two opposite directions, depending on which groove is engaged with the stream; a shift lever extending substantially horizontally and mounted on the cage for confined pivotal rotation about another vertical axis, parallel to the one vertical axis, the shift lever having an inner portion with an aperture therein through which a stream emitted from the nozzle may pass; and a stop assembly secured in the cap and including a first annular ring formed with a fixed reversing stop, and a second annular ring mounted on the first annular ring for rotation relative to the first annular ring, the second annular ring having a movable reversing stop adjustable relative to the fixed reversing stop; and wherein the shift lever is arranged to rotate with the cage and spray plate about the one vertical axis between the fixed reversing stop and the movable reversing stop, and to rotate about another vertical axis after engagement with one of the fixed reversing stop and movable reversing stop.

DETAILED DESCRIPTION OF THE INVENTION

Figure 1:
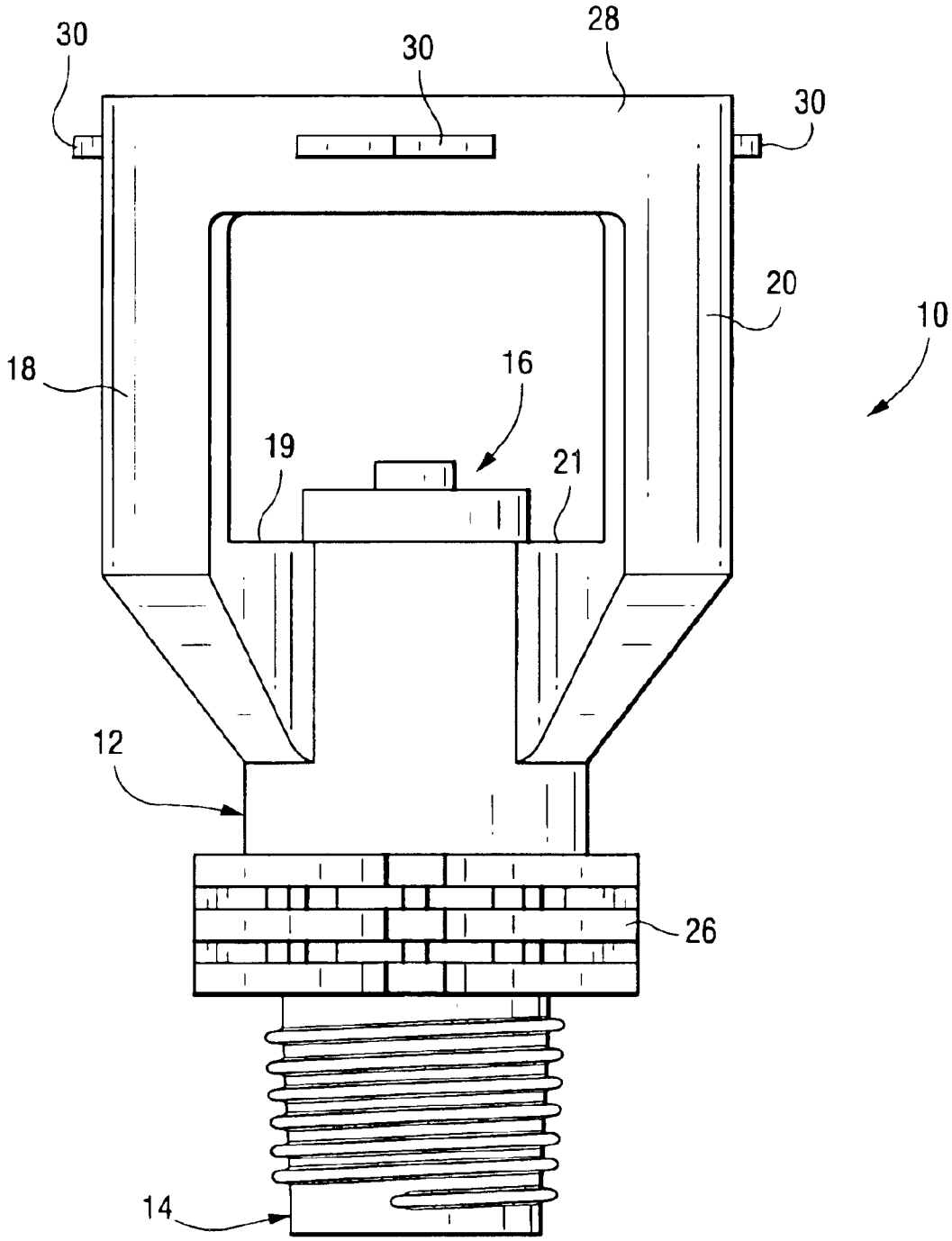
FIG. 1 is a side elevation of a sprinkler head, with parts removed for clarity.
Figure 2:
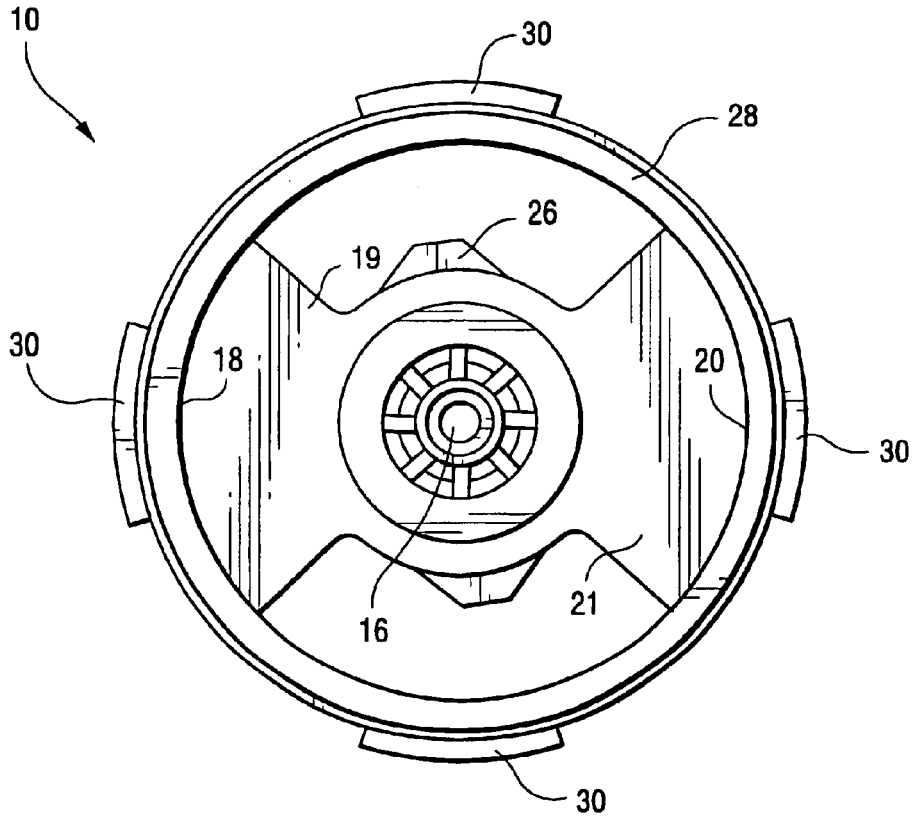
FIG. 2 is a plan view of the sprinkler head shown in FIG. 1.
Figure 4:
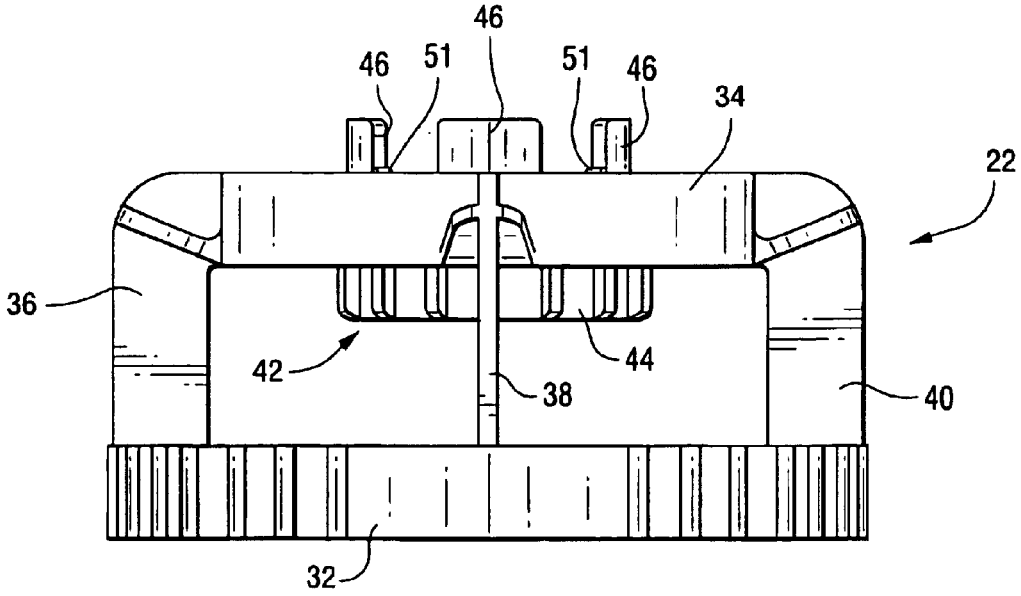
FIG. 4 is a side elevation of a cap component for the sprinkler head shown in FIG. 1.
Figure 3:
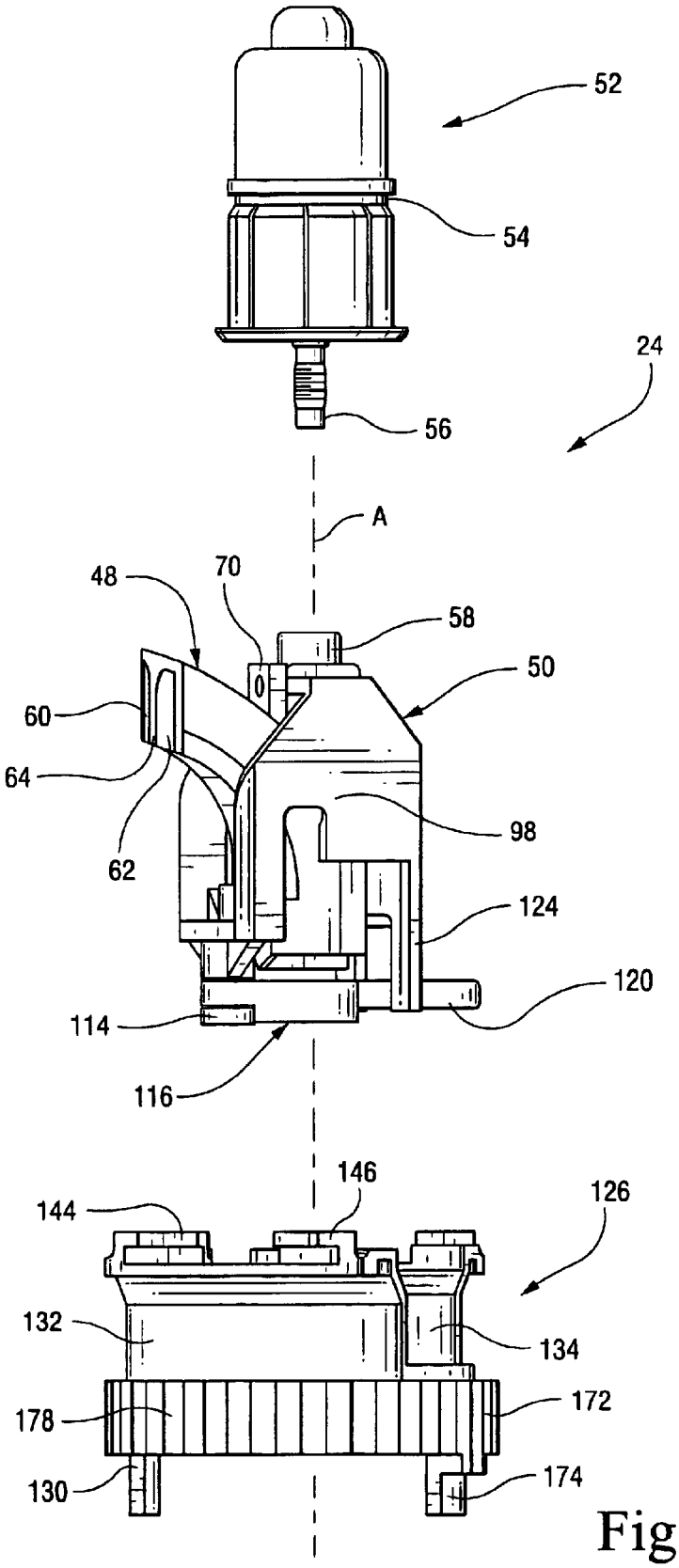
FIG. 3 is an exploded elevation, illustrating a spray plate assembly and a stop assembly for attachment to the cap shown in FIG. 4.
Figure 5:
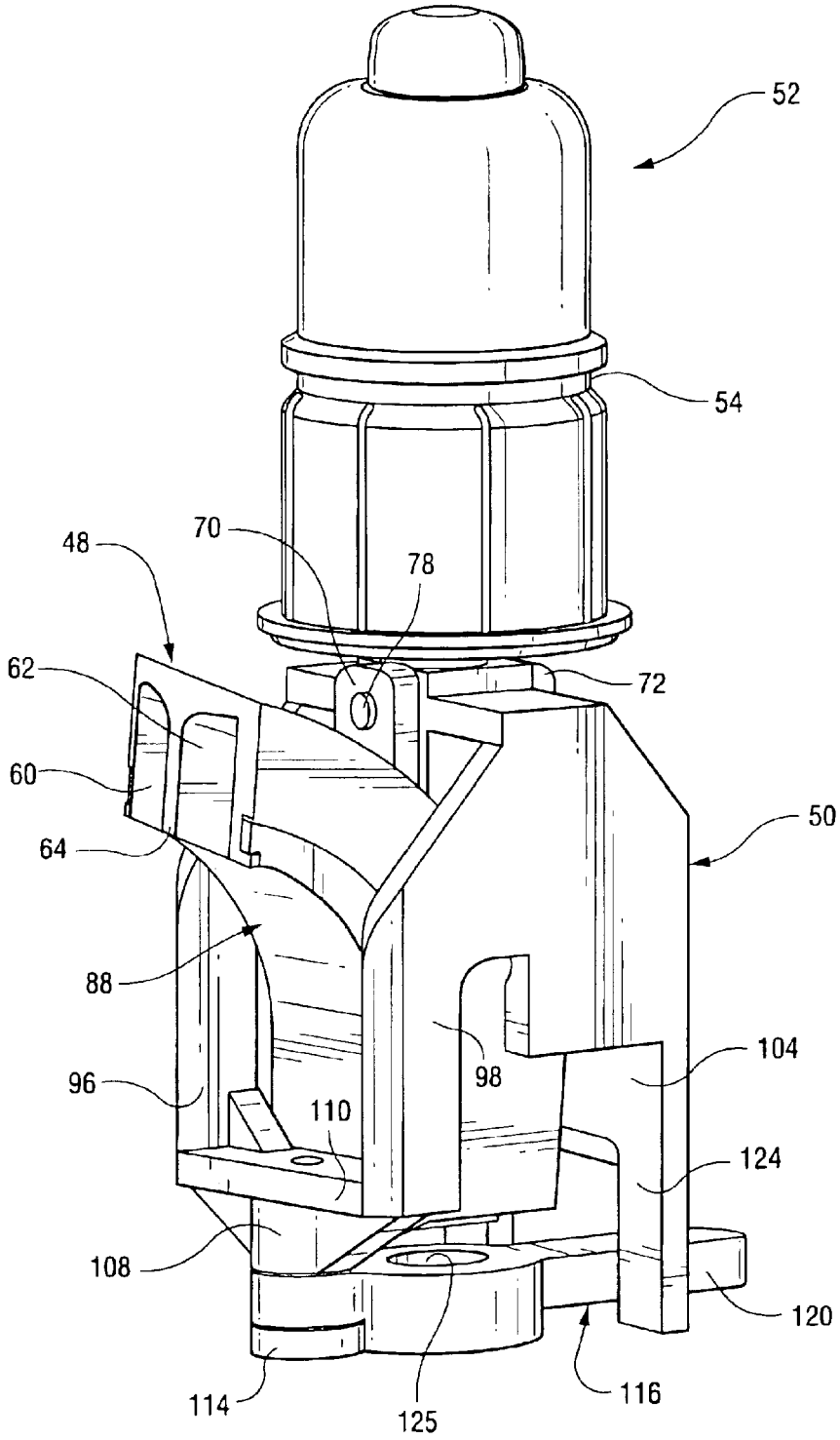
FIG. 5 is a perspective view of the spray plate assembly including a retarder motor, spray plate and spray plate cage in assembled relationship.
Figure 6:
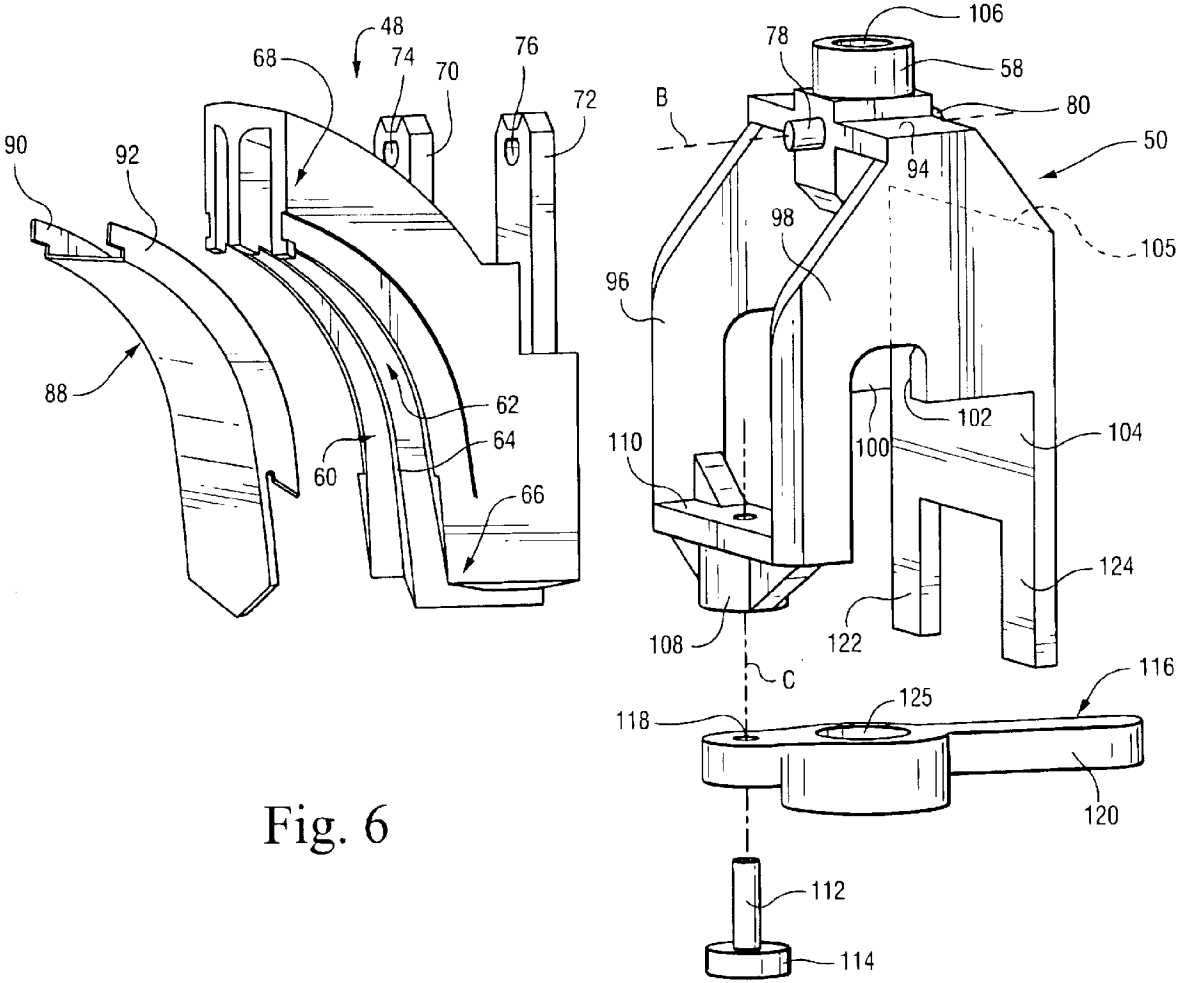
FIG. 6 is an exploded perspective view of the spray plate and spray plate cage for use with the sprinkler head shown in FIG. 1.
Figure 8:
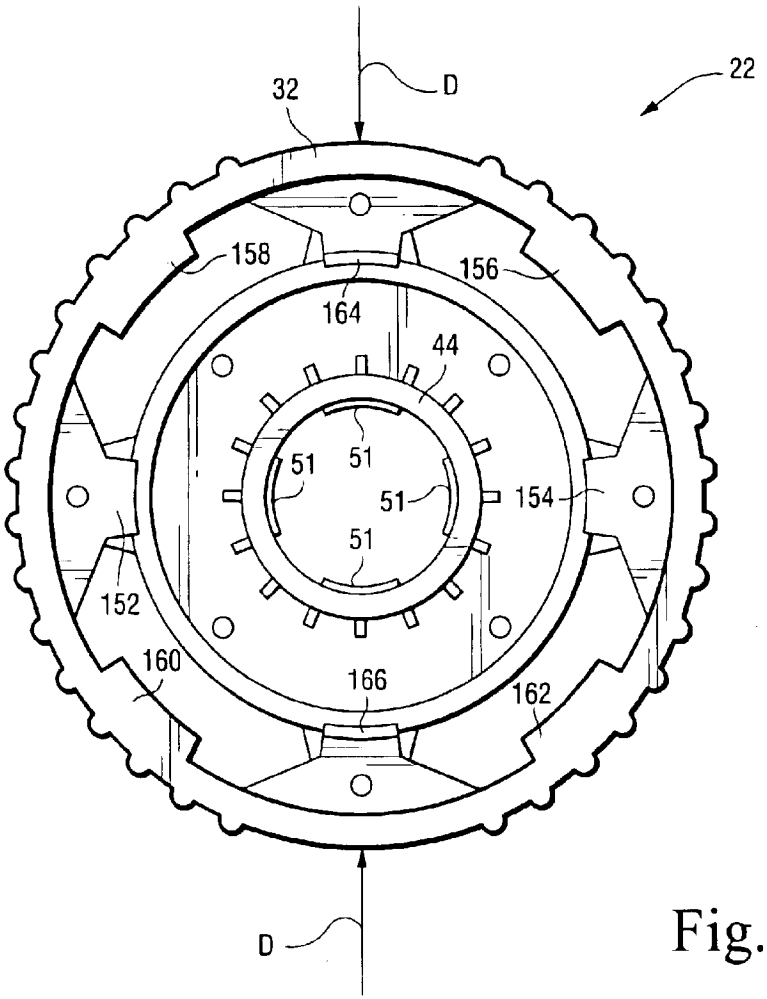
FIG. 8 is a bottom plan view of the cap shown in FIG. 4.
Figure 15:
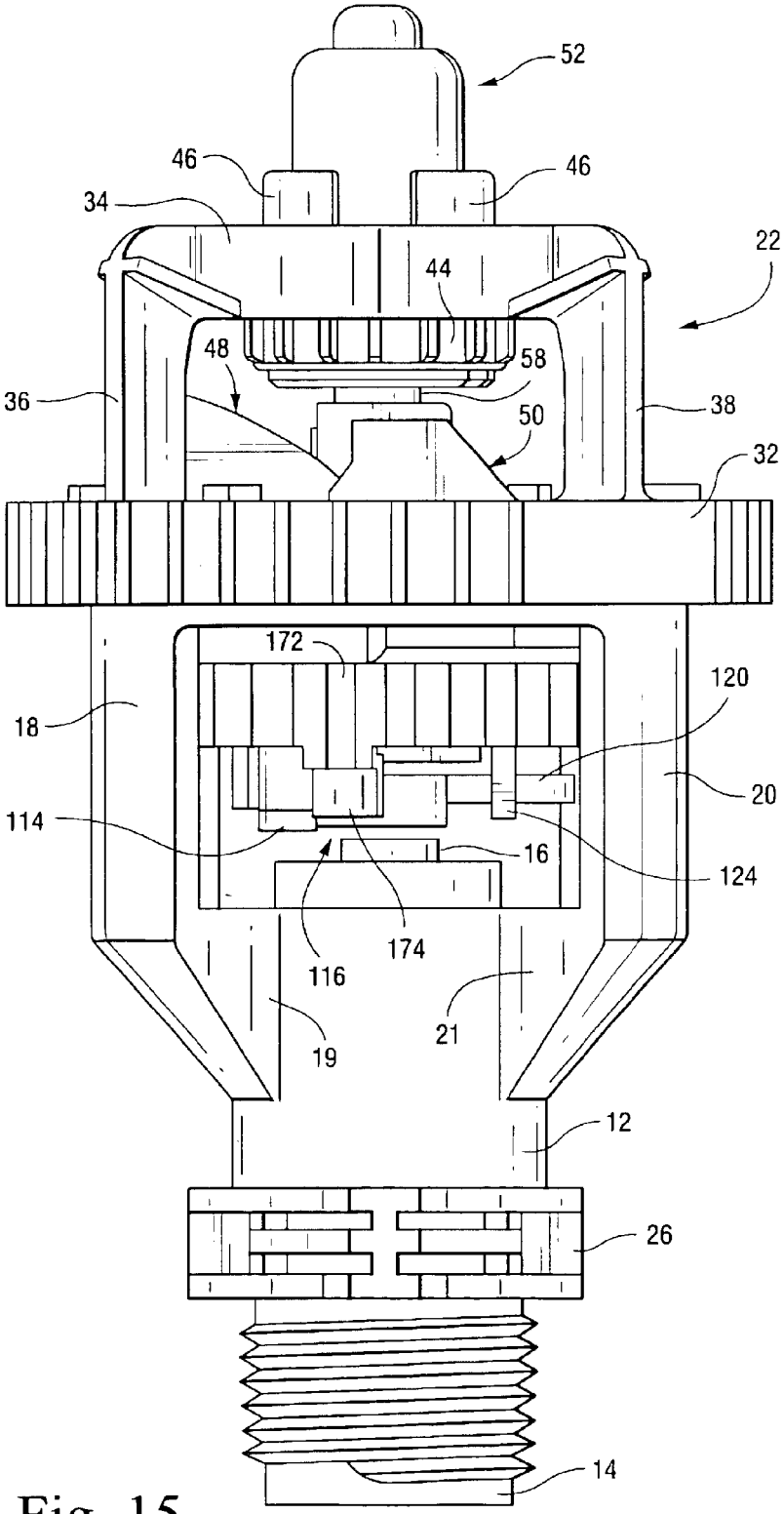
FIG. 15 is a front elevation of an assembled sprinkler head in accordance with the invention.

With reference to FIG. 1, a sprinkler head 10 is illustrated in part, showing a sprinkler body 12 including an inlet 14 and a nozzle 16 that is arranged to emit a single stream coaxial with the longitudinal axis of the sprinkler head. The sprinkler body 12 is provided with a pair of upstanding struts or supports 18 and 20 that extend upwardly from respective radially outwardly extending base portion 19 and 21. The struts 18, 20 are adapted to mount a cap 22 (see FIGS. 4, 8 and 15) that supports a rotatable spray plate assembly 24 and a stop assembly 126 (FIG. 3). The inlet 14 is adapted to be secured to a water supply component such as a fixed riser or the like. An integral nut 26 can be utilized to thread the sprinkler head onto the water supply component.

The struts 18, 20 terminate at an annular ring 28 provided with a plurality of radially outwardly directed tabs 30 by which the cap 22 can be secured in a known fashion, e.g., in a press and twist configuration.

The cap 22 (FIG. 4) includes a lower annular ring 32 and an upper annular ring 34 connected by four upstanding struts (three of which are shown at 36, 38 and 40) on 90° spacing. The upper annular ring 34 is formed with an integral center hub 42 that includes an annular ring 44 on the underside of the hub, and a plurality of upstanding tabs 46 on the upper side of the hub. The hub 42 supports the spray plate assembly 24 shown in exploded view in FIG. 3. The spray plate assembly 24 includes a spray plate 48, a spray plate cage 50, and a viscous retarder motor 52. The viscous retarder motor 52 slows the speed of rotation of the spray plate 48 as described further herein, and may be constructed as disclosed in commonly owned U.S. Pat. Nos. Re. 33,823; 5,058,806 and 5,288,022. The retarder motor 52 is press fit and snapped into place within the hub 42 of the cap 22, with a lower portion of the motor engaged by annular ring 44 and a middle portion of the motor engaged by the tabs 46. The latter may be formed with horizontally oriented ribs 51 (FIGS. 4 and 8) on interior surfaces thereof that are engaged in the groove 54 in the motor housing. A motor shaft 56 is received in a bushing 58 on the spray plate cage 50 so that the spray plate cage and spray plate rotate about a first vertical axis A coincident with shaft 56, and is slowed by the viscous retarder motor 52. Axis A is also coincident with the longitudinal axis of the sprinkler body, passing through the center of nozzle 16.

With reference also to FIGS. 5, 6, 9 and 10, the spray plate 48 is formed with a pair of side-by-side parallel grooves 60, 62 separated by a center wall or barrier 64. The grooves are generally vertically oriented at an inlet end 66 thereof, but transition to an almost horizontal orientation at an outlet end 68 (see FIG. 6). The spray plate 48 is also formed with a pair of vertically oriented, aligned mounting tabs 70, 72 having apertures 74, 76, respectively, by which the spray plate is pivotally mounted on a pair of aligned pins 78, 80 on the spray plate cage 50, for swinging movement about a horizontal axis B defined by the pins 78, 80.

The inlet end 66 of groove 60 is flared at 84, and the center barrier 64 is chamfered at 86 so that, on start-up, more of the stream emitted from nozzle 46 will enter groove 60 than 62, causing the spray plate to tilt about axis B, resulting in all of the stream flowing into groove 60. Because the stream exit point for the groove 60 is offset from the axis of rotation A of the plate, the plate will rotate about axis A to distribute the stream in a part circular pattern. This action will be described in greater detail below.

A cover or shield 88 (FIG. 6) including side walls 90, 92 may be snapped into place over the open faces of the grooves 60, 62 to confine the stream to the grooves between the inlet and outlet ends 66, 68.

The spray plate cage 50 that carries the spray plate 48 includes a top surface 94 and a pair of side walls 96, 98 that confine movement of the spray plate 48 on the pins 78, 80. Specifically, the spray plate 48 is free to tilt back and forth between two stop surfaces 100, 102 (best seen in FIG. 10) of the side walls 96, 98. Note that the back wall 104 is open in the area above reference number 105, allowing the tab 72 to be attached to the pin 80.

The bushing 58 extending above the top surface 94 includes an aperture 106 that receives the retarder shaft 56 in a friction, spline or other suitable fit.

A second bushing 108 projecting from a lower bar 110 extending between the side walls 96, 98 is formed with a blind bore for receiving a pivot pin 112 formed with an integral head 114 that serves to mount a shift lever 116 via hole 118 for rotation about a second vertical axis C coincident with the pin 112. An extended lever portion 120 of the shift lever 116 is thus free to move back and forth between a pair of depending tab stops 122, 124 at the lower end of the back wall 104. An aperture 125 in the shift lever interacts with the stream emitted from the nozzle as explained further herein.

Figure 7:
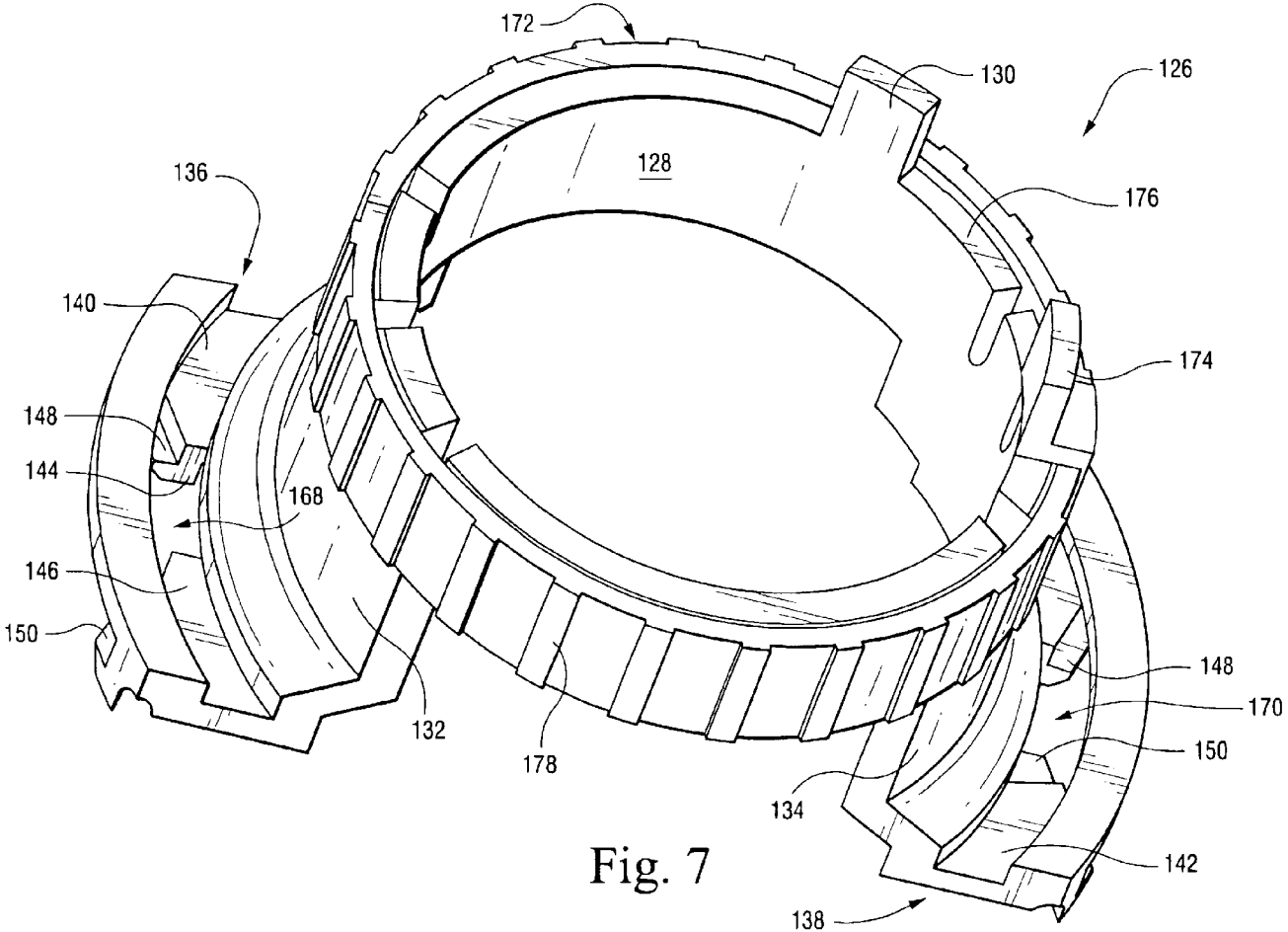
FIG. 7 is an inverted perspective view of the stop assembly shown in FIG. 3.
Figure 14:
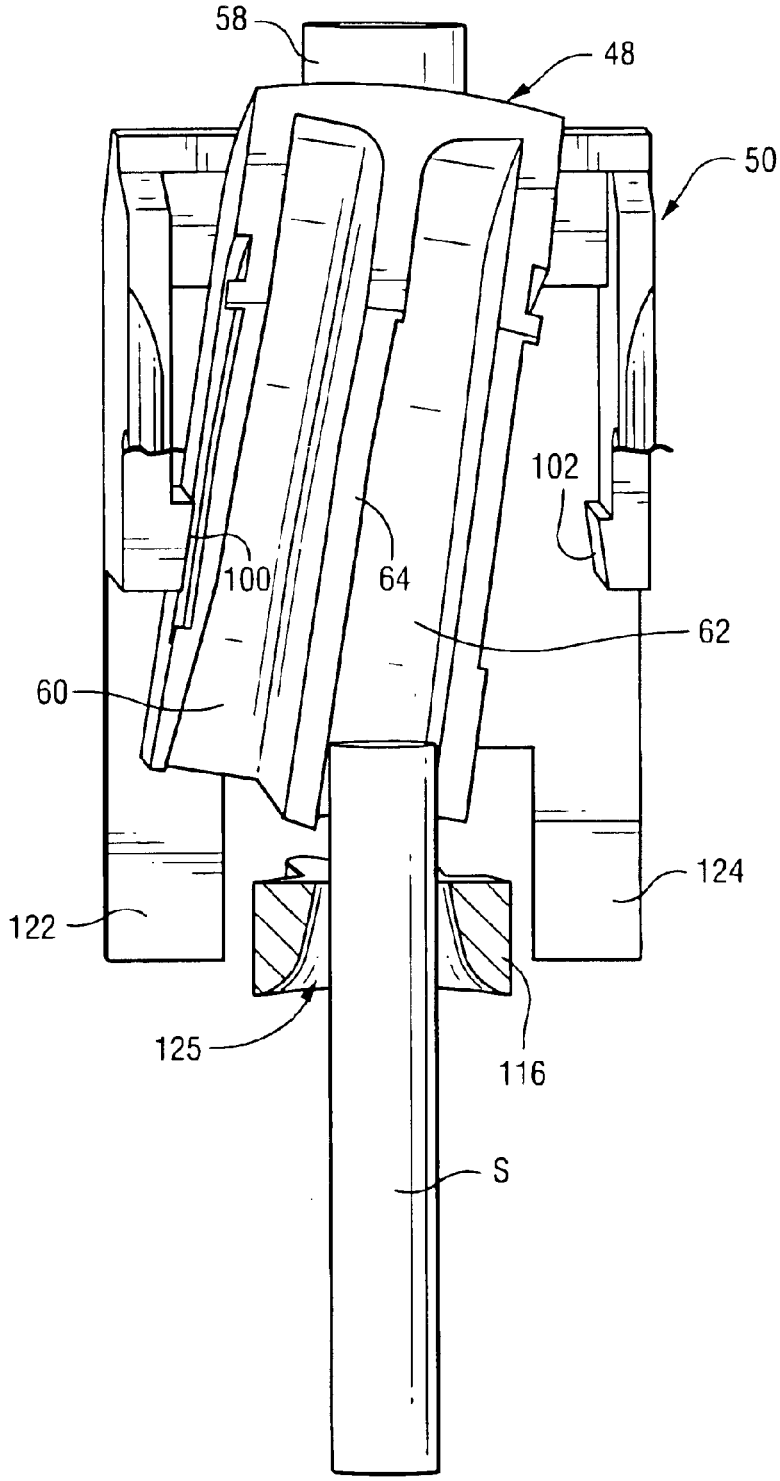
FIG. 14 is a front elevation similar to FIGS. 10, 11 and 13, but illustrating the stream fully shifted into the other of the two grooves.

Referring now to FIG. 3 and especially FIG. 7, the stop assembly 126 includes an inner annular ring 128 having a first fixed reversing stop 130. The annular ring 128 is also formed with a pair of diametrically opposed, part annular walls 132, 134 that terminate at radially outwardly directed attachment flanges 136, 138. These flanges are formed with grooves 140, 142, respectively, on the lower side thereof (note: in FIG. 7, the stop plate assembly is inverted from its normal orientation shown in FIGS. 3 and 14). The upper sides of the flanges 136, 138 are each formed with a pair of opposed wedge elements 144, 146 that taper inwardly and are undercut to form seating surfaces 148, 150 on each flange for receiving tabs 152, 154 on the interior of the cap ring 32 (at the upper end of the ring). Tabs 156, 158, 160 and 162 (at the lower end of the cap ring 32) cooperate with tabs 30 to secure the cap 22 to the annular ring 28 of the sprinkler body, but also assist in locating the stop assembly 126 when attaching it to the cap 22. Vertical tabs 164, 166 also force the assembler to properly locate the stop assembly for interaction with the tabs 152, 154. Squeezing the cap ring 32 at points indicated by arrows D provides the space necessary to seat the stop assembly within the cap, and apertures 168, 170 in the flanges 136, 138 permit the assembler to verify that the tabs 152, 154 are correctly seated.

The stop assembly 126 also includes an outer ring 172, telescoped over the inner ring 128, utilizing a snap fit or other suitable attachment mechanism that allows ring 172 to rotate relative to ring 128. Outer ring 172 is formed with a second, movable reversing stop 174 that is radially inwardly offset from the ring 172, such that it rides on the edges 176 of the inner ring. The user is thus able to move reversing stop 174 relative to the fixed reversing stop 130 to obtain a desired arc through which the spray plate will rotate before reversing direction. Ring 172 may be provided with circumferentially spaced ribs 178 (or other suitable surface texture) to facilitate rotation of the ring.

Figure 9:
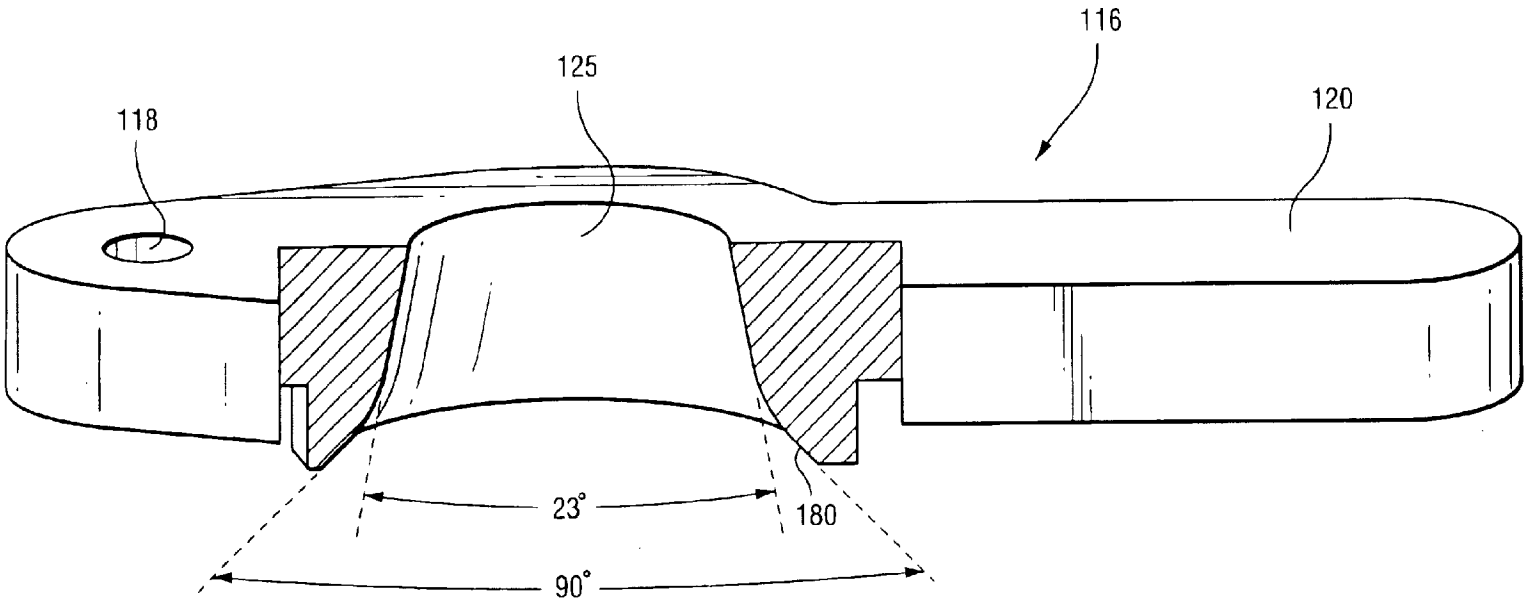
FIG. 9 is a side elevation, partly in section, of a shift lever component, taken from the spray plate cage as shown in FIGS. 4 and 5.
Figure 10:
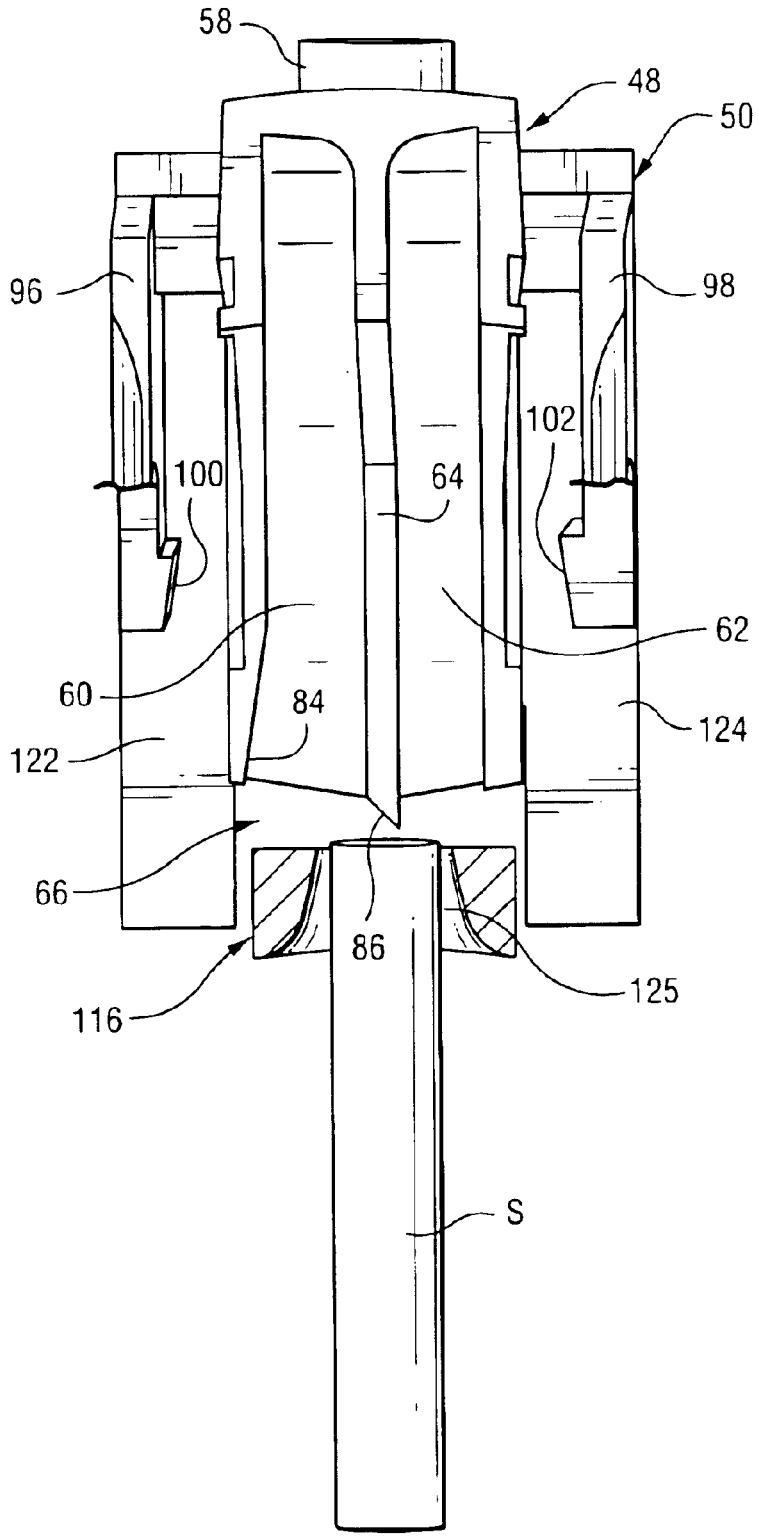
FIG. 10 is a partial front elevation, partly broken away, illustrating how a stream of water impinges on the spray plate on start-up.
Figure 11:
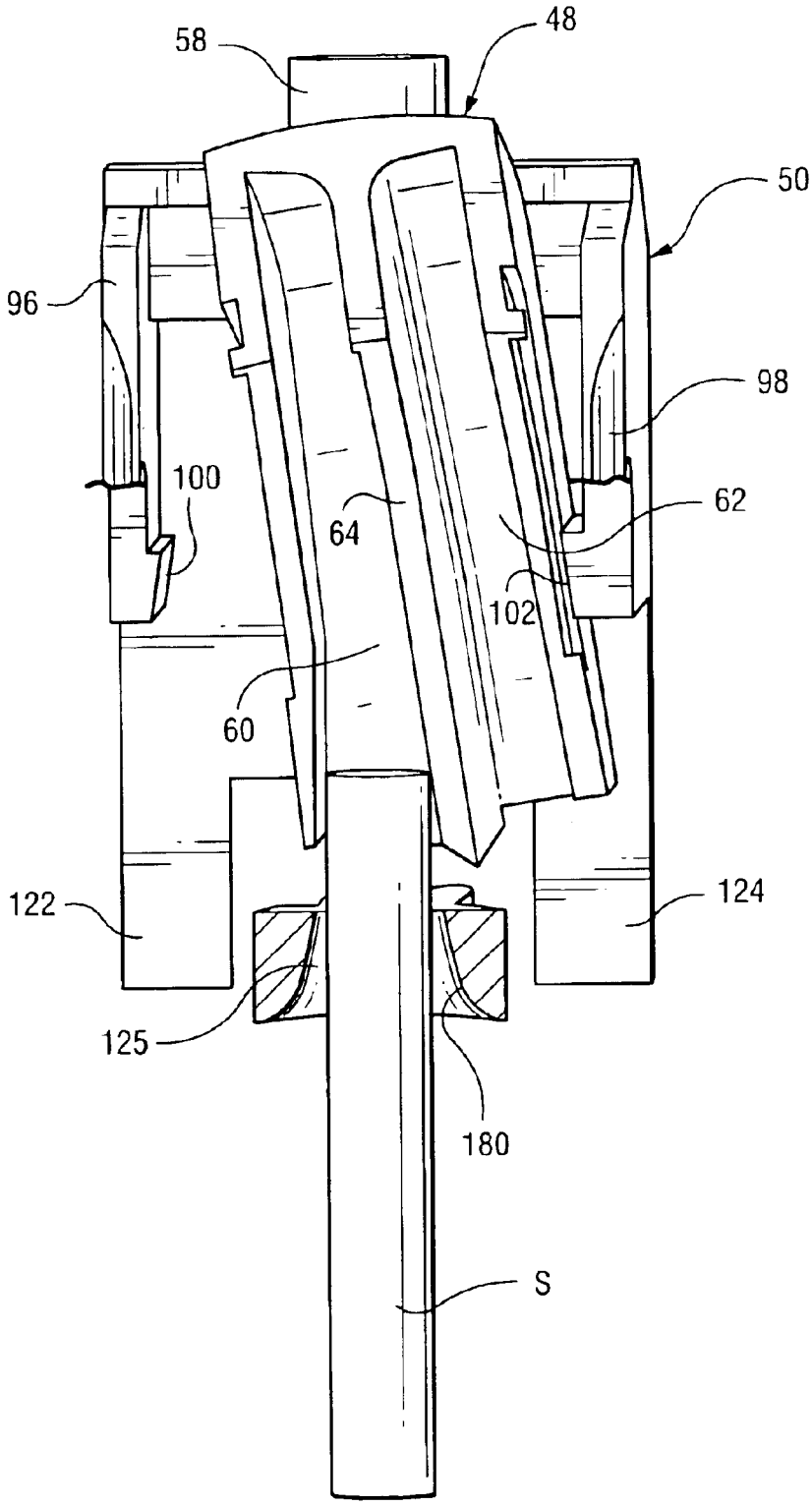
FIG. 11 is an elevation similar to FIG. 10, but illustrating the stream entering one of two grooves on the spray plate after start-up.

Before describing the operation of the sprinkler head, reference is made to FIG. 9 where the shift lever 116 is shown in enlarged form. The aperture 125 is adapted to receive a stream S emitted from the nozzle 16. The inlet to the aperture 125 is tapered as shown at 180 to facilitate entry of the stream as described below. The main portion of the aperture is tapered outwardly in a downward direction, opposed points describing an arc of about 23°. At its widest point, opposed points of the tapered inlet describe a 90° arc.

With reference now especially to FIGS. 10–14, it will be appreciated that on start-up, the stream S exiting nozzle 16 passes through the aperture 125 in the lever 116, and the aperture shape creates a venturi effect that causes the lever to "center up" around the stream. The stream initially impinges on the barrier 64 of the spray plate 58, and the beveled or chamfered edge 86 deflects more water into groove or channel 60, preventing a "null" or "equalization" of the stream that would otherwise cause the plate not to rotate, i.e., to stall. The force of the stream S entering the spray plate groove 60, and coming into contact with the side of the center barrier 64 tilts the spray plate 68 in a counterclockwise direction about axis B (FIG. 11), with the spray plate 48 engaged with stop surface 102 on the spray plate cage 50. The stream passing through the groove 60 is directed it to an offset exit position relative to the axis of rotation A of the spray plate assembly, thus causing the spray plate 48 and cage 50 to rotate about axis A in a first direction (counterclockwise as viewed in FIG. 12).

Figure 12:
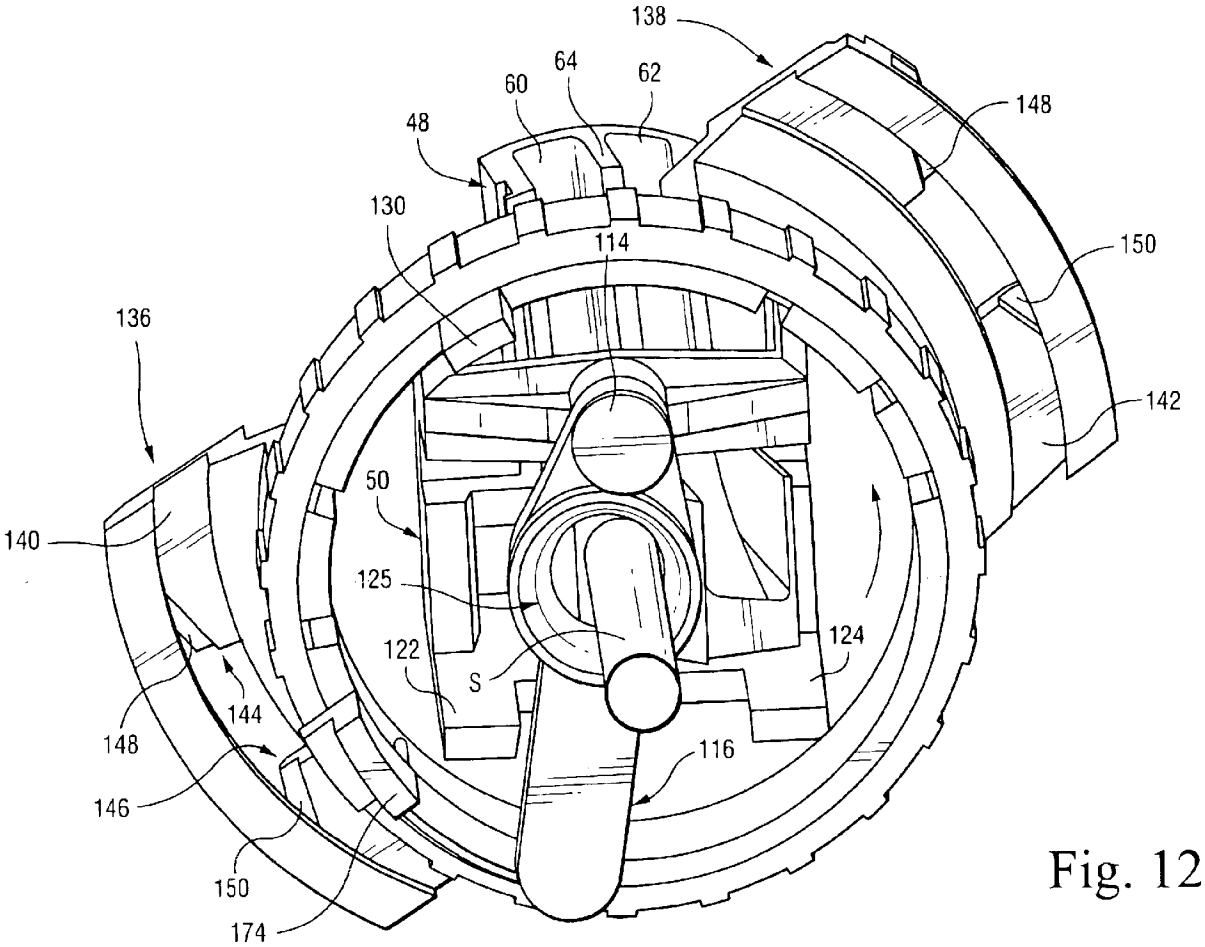
FIG. 12 is a bottom perspective view of the spray plate, spray plate cage and stop assembly in accordance with the invention.
Figure 13:
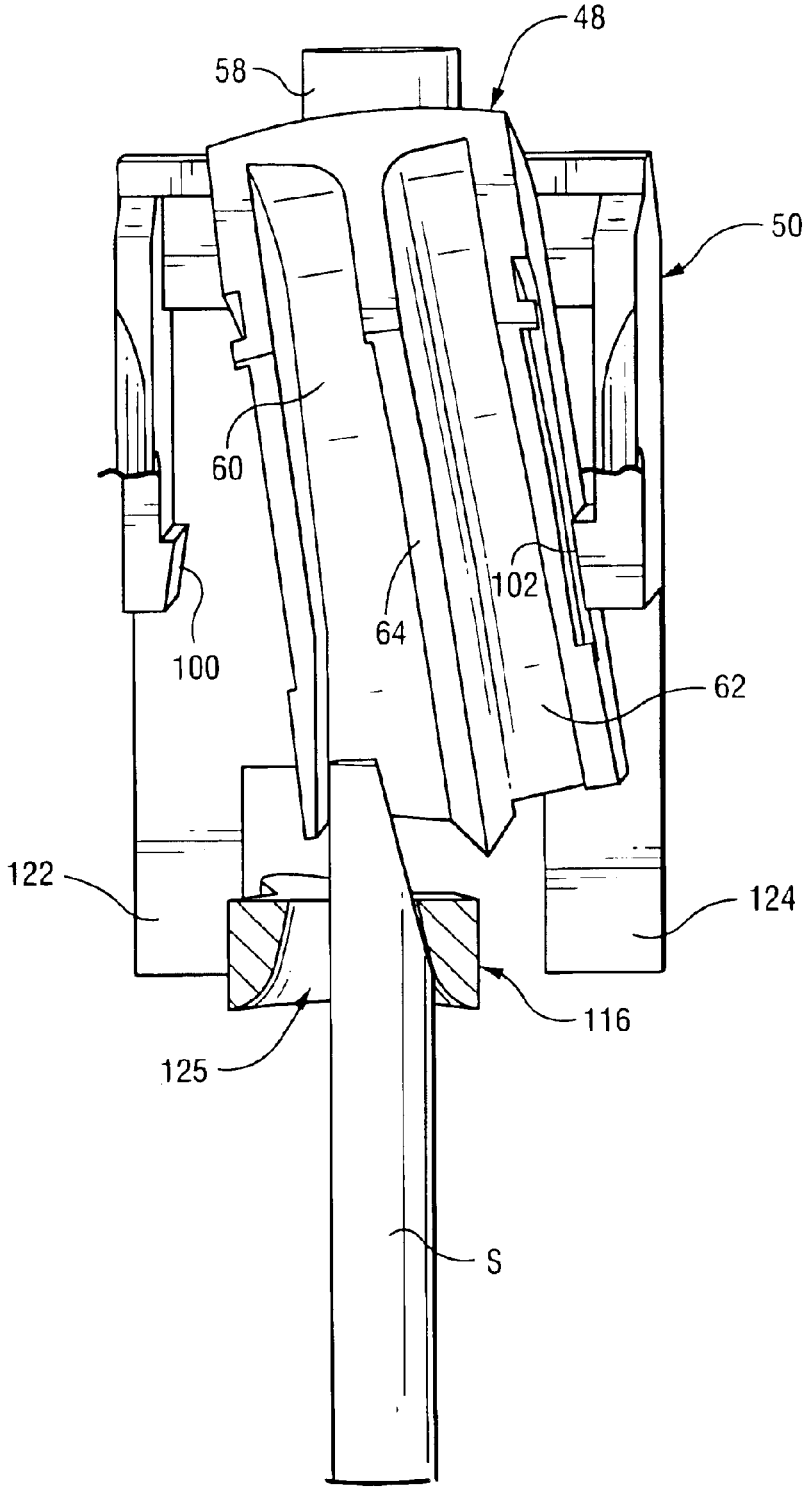
FIG. 13 is a front elevation, similar to FIGS. 10 and 11, but illustrating the manner in which the shift lever acts to shift the stream from one groove to the other.

Turning to FIG. 12, as the spray plate assembly 24 rotates about axis A, the shift lever 116 rotates with the plate about the same axis, until a remote end of the lever portion 120 comes into contact with fixed reversing stop 130. This causes the shift lever to stop rotating with spray plate 48 on axis A, and to begin rotation about axis C (pin 114). As the spray plate assembly continues to rotate, the shift lever 116 will be forced to enter the stream S (FIG. 3). As the shift lever 116 moves into the stream, it deflects the stream away from the center barrier 64, allowing the upward force created by the stream being arced outward to the offset exit point of the groove 60 to overcome the force on the center barrier. This causes the spray plate to pivot about axis B (pins 78, 80) and to tilt in a clockwise direction to the position shown in FIG. 14. Now the stream S shifts to groove 62. Once the stream enters groove 62, reversal of the direction of the spray plate 58 occurs. The shift lever 116 will remain in contact with the stream S until the spray plate 68 has shifted (i.e., until the spray plate tilts into engagement with stop 104, see FIG. 14) and the spray plate assembly has started to rotate in the opposite or reverse direction. As rotation in the opposite direction continues, the shift lever 116 will come off the stop and the venturi effect within aperture 125 will once again center up the shift lever 116 on the stream S. The lever 116 will eventually contact the adjustable reversing stop 174, and the reversing process will be repeated.

Rotation of ring 172 relative to ring 128 on the stop assembly 52 will vary the arc of coverage of the stream and thus vary the sprinkling pattern, as desired.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reversible, adjustable arc sprinkler head comprising a sprinkler body incorporating a fixed nozzle; a spray plate mounted for rotation in one or the other of two opposite directions about a first axis arranged coaxially with a stream emitted from the nozzle, and for back and forth tilting motion about a second axis perpendicular to said first axis, said spray plate having a pair of substantially parallel grooves for selectively receiving the stream, depending on a direction of tilt of the spray plate; and a shift lever formed with an aperture sized to receive said stream, said shift lever mounted at one end for rotation about a third axis parallel to said first axis, said shift lever enabled to shift the stream from one of said pair of grooves to the other of said pair of grooves to thereby reverse the direction of rotation of the spray plate.

2. The sprinkler head of claim 1 wherein said spray plate is supported in a cage having a pair of stop surfaces for confining the tilting motion of the spray plate.

3. The sprinkler head of claim 2 wherein said cage also includes a pair of tab stops engageable by a portion of said shift lever, beyond said aperture.

4. The sprinkler head of claim 1 wherein said aperture in said shift lever is shaped to provide a venturi effect which centers the stream within the aperture.

5. The sprinkler head of claim 3 and further comprising a pair of reversing stops arranged for engagement by a remote end of said shift lever, said shift lever normally rotating with said spray plate until said shift lever engages one of said reversing stops, causing said shift lever to cease rotating about said first axis and commence rotating about said third axis.

6. The sprinkler head of claim 5 wherein, when said shift lever rotates about said third axis between said tab stops, the shift lever causes the stream to shift to the other of said pair of grooves which, in turn, causes said spray plate to tilt and reverse the direction of rotation.

7. The sprinkler head of claim 1 wherein rotation of said spray plate is slowed by a viscous retarder motor.

8. The sprinkler head of claim 1 wherein said pair of grooves are each comprised of a vertical inlet portion and a generally horizontal, radially outward outlet portion.

9. The sprinkler head of claim 1 wherein said aperture in said shift lever is flared at an inlet portion thereof, describing an angle of about 90° between two diametrically opposed surfaces thereof.

10. A reversible, adjustable arc sprinkler head comprising a sprinkler body incorporating a nozzle having a discharge orifice; a cap releasably mounted on the body; a spray plate mounted in a cage for tilting motion relative to the cage about a horizontal axis; the cage and spray plate mounted in said cap for rotation relative to said sprinkler body about one vertical axis perpendicular to said horizontal axis, said spray plate having formed therein a pair of substantially parallel grooves adapted to be sequentially aligned with said nozzle for receiving a stream from said nozzle, said pair of grooves separated by a center barrier and configured to cause rotation of said cage and spray plate in one of two opposite directions, depending on which groove is engaged with the stream;

a shift lever extending substantially horizontally and mounted on said cage for confined pivotal rotation about another vertical axis, parallel to said one vertical axis, said shift lever having an inner portion with an aperture therein through which a stream emitted from said nozzle may pass; and a stop assembly secured in said cap and including a first annular ring formed with a fixed reversing stop, and a second annular ring mounted on said first annular ring for rotation relative to said first annular ring, said second annular ring having a movable reversing stop adjustable relative to said fixed reversing stop; and wherein said shift lever is arranged to rotate with said cage and spray plate about said one vertical axis between said fixed reversing stop and said movable reversing stop, and to rotate about said another vertical axis after engagement with one of said fixed reversing stop and movable reversing stop.

11. The sprinkler head of claim 10 wherein said cage also includes a pair of tab stops engageable by a portion of said shift lever, beyond said aperture.

12. The sprinkler head of claim 10 wherein said aperture in said shift lever is shaped to provide a venturi effect which centers the stream within the aperture.

13. The sprinkler head of claim 10 wherein rotation of said spray plate is slowed by a viscous retarder motor.

14. The sprinider head of claim 10 wherein said pair of grooves are each comprised of a vertical inlet portion and a generally horizontal, radially outward outlet portion.

15. The sprinkler head of claim 10 wherein said aperture in said shift lever is flared at an inlet portion thereof, describing an angle of about 90° between two diametrically opposed surfaces thereof.

* * * * *